US006788183B2

(12) United States Patent
Von Der Weth et al.

(10) Patent No.: US 6,788,183 B2
(45) Date of Patent: Sep. 7, 2004

(54) I-INDUCTOR AS HIGH-FREQUENCY MICROINDUCTOR

(75) Inventors: Axel Von Der Weth, Karlsruhe (DE); Klaus Seemann, Durmersheim (DE); Immanuel Fergen, Karlsruhe (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 0 days.

(21) Appl. No.: 10/347,153

(22) Filed: Jan. 13, 2003

(65) Prior Publication Data

US 2003/0160675 A1 Aug. 28, 2003

Related U.S. Application Data

(63) Continuation-in-part of application No. PCT/EP01/07616, filed on Jul. 4, 2001.

(30) Foreign Application Priority Data

Jul. 14, 2000 (DE) ..... 100 34 413
Feb. 2, 2001 (DE) ..... 101 04 648

(51) Int. Cl.[7] ..... H01F 5/00
(52) U.S. Cl. ..... 336/200; 336/223; 336/232; 336/174

(58) Field of Search ..... 336/200, 223, 336/232, 83, 174, 175, 212, 602.1; 29/602.1

(56) References Cited

U.S. PATENT DOCUMENTS 4,331,919 A * 5/1982 Beckley ..... 324/222
4,891,717 A * 1/1990 Minuhin ..... 360/41
5,609,946 A 3/1997 Korman et al.
6,341,414 B1 * 1/2002 Leu ..... 29/602.1

FOREIGN PATENT DOCUMENTS

DE 33 46 659 7/1985
EP 0 684 616 11/1995

* cited by examiner

*Primary Examiner*—Anh Mai
(74) *Attorney, Agent, or Firm*—Klaus J. Bach

(57) ABSTRACT

In an I-conductor for the high-frequency or microwave systems, two uniform cores are disposed parallel to each other with a gap therebetween and a coil is disposed on each core in such a way that, when energized by an HF current, a magnetic circuit through the two cores is generated by way of the gap at one end of the arrangement. The magnetic field forming windings are uniform. As cores, magnetically anisotropic materials may be used.

9 Claims, 5 Drawing Sheets

I-INDUCTOR AS HIGH-FREQUENCY MICROINDUCTOR

This is a continuation-in-part application of international application PCT/EP01/07616 filed Jul. 4, 2001 and claiming the priority of German applications 100 34 413.5 filed Jul. 14, 2000 and 101 04 648.0 filed 0202 01.

BACKGROUND OF THE INVENTION

The invention relates to an I-inductor, which represents a passive magnetic component, for high frequency or microwave technology, that is a HF inductor.

Such inductors are known in the transformer field as macroscopic components where they consist of an isotropic magnetically permeable material. They are also known as HF micro-inductors in micro-systems engineering or in integrated circuit designs in "on-die" construction (on die= disposed on a chip or a substrate), wherein for field-permeated bodies or cores materials with a single-axis, non-axial anisotropy are used in order to be effective also at high frequencies.

By the shape of the magnetically permeated parts, a reduction of the fields leaving the components is achieved which greatly reduces the formation of shielding currents in the support structures of the component or of electromagnetic disturbances in adjacent components. The arrangement of an I-inductor is relatively compact so that parasitic capacities can be kept small. By a suitable conditioning and utilization of surface conductor, arrangements can be provided which reduce the resistance and which improve the grade.

Annular core impedance coils or toroidal micro-inductors are similar in design and in operation. They consist reasonably only of isotopic materials. Magnetic materials with single axis-, in technical terms uni-axial anisotropy, cannot be used. According to the present state of the material science, isotropic magnetic materials are not suitable for the frequency range above 1 GHz [1].

For solenoids or cylindrical coils the same considerations apply. Various embodiments are known in this regard:

In micro-systems engineering, the solenoid is also used as a planar coil, wherein the coil axis extends normal to the substrate. For high frequencies such arrangements are usable in only a limited way since shielding currents are generated in the substrate which reduce the inductivity. These components have a low grade for high frequency applications.

Since the arrangement has a low efficiency particularly in connection with high frequencies, the components are made relatively large which increases also the parasitic capacities. By the use of additional magnetic layers at the front surfaces of the planar coils, the inductivity can-be increased but the frequency limit of the coil is reduced thereby. The quality of the coil can be increased by the use of wide conductor elements in the planar coil but this is possible only to a small extent since, in a planar coil, the required area increases thereby. [II]. Above 0.1 GHz such a design is of no interest because of a pronounced increase of the capacity and eddy current problem. Also, it is only possible with magnetically isotropic materials.

Another group includes solenoids, whose coil axes extend parallel to the substrate. Also, these solenoids are suitable for the high frequency range only under certain conditions because of the excitation of shielding currents in the substrate since the stray field exits at the front surfaces. However, for increasing the inductivity, a core of a material with magnetically non-axial anisotropy may be used [III].

Furthermore, flat conductors are used as inductors. The effectiveness achievable thereby, however, is too low in the frequency range mentioned for technical applications because of the low inductivity. To increase the effectiveness, the conductor can be surrounded by a magnetic material. This solution is already used for macroscopic components with isotropic magnetic materials and is discussed in the literature as micro-inductor application [IV]. Since, in this case for example, the shape anisotropy of these layers is not taken into consideration and the conditions used are highly simplified, an application in microsystems engineering is rather questionable. The arrangement leads to a substantial excitation of shielding currents in the substrate, which complicates an industrial high frequency application. Since there are likely substantial strong fields, this has to be taken into consideration in the design of the surrounding electromagnetic components.

The relevant known state of the art can be summarized as follows:

Annular core impedance coils, which consist of materials with magnetically uniaxial anisotropy, are not effective. Impedance coils consisting of magnetically isotropic materials are not usable for the frequency range under consideration.

Solenoids are not suitable because of the stray fields, which generate shielding circuits and, as a result, cause disturbances in adjacent components.

Flat conductors have too low an inductivity or too high a parasitic capacity.

It is therefore the object of the present invention to provide high power inductors, which are economical and suitable for industrial manufacture.

SUMMARY OF THE INVENTION

In an I-conductor for high-frequency or microwave systems, two uniform cores are disposed parallel to each other with a gap therebetween and a coil is disposed on each core in such a way that, when energized by an HF current, a magnetic circuit through the two cores is generated by way of the gap at one end of the arrangement. The magnetic field-forming windings are uniform. As cores, magnetically anisotropic materials may also be used.

Preferably, the material of the bodies or cores is magnetically isotropic or it is uni-directionally or uni-axially magnetically anisotropic.

The geometric relation of the two outer bodies or cores of the arrangement with respect to bodies or cores disposed in between is such that the two outer bodies or cores have the same width and those in between are at least as wide.

Suitable winding techniques and arrangements are the following: the winding comprises a solenoid for each body or core. The turns of a winding form, together with the bodies or cores a web structure. One turn or the turns may consist of a flat conductor, which at each of its ends is provided with a connector structure for an external connection. The turns of the winding may also include band-like rectangular elements, which then may comprise:

- two cores which are arranged side-by-side and are evenly trapezoid-shaped, wherein in the gap between the two cores two trapezoidal elements are disposed adjacent each other and are in contact by the two shorter of the two parallel sides of the trapezoid and aligned along the outer longitudinal edges of the bodies/cores and in electrical contact with each other;
- more than two cores which are disposed adjacent each other as the elements of a winding on the two outer bodies/cores and are trapezoidal in the same way and rectangular at the inner cores. They are arranged adjacent one another in alignment and are in contact, along the outer edge of the two outer cores, with the longer of the two parallel trapezoidal sides. In the respective gap between the two outer cores and the next adjacent core at the shorter side of the two parallel trapezoidal sides of an element of the winding a rectangular element of the winding with a side of equal length is disposed and is in electrical contact therewith. In the respective gap between the inner cores, two rectangular elements of the winding are disposed adjacent, and in contact with, one another. As a result, the winding elements are disposed fabric-like adjacent one another while maintaining the required minimum distance for isolation. At both ends of a coil a connecting tab is provided for an external connection.

The I-inductor is therefore suitable for high limit frequencies up to 10 GHz with sufficient quality Q<500. Expediently, the HF permeability in the direction of the magnetic field axis is disposed in the cores. With the arrangement of the conductor elements and the bodies or layers of magnetic material, the shielding currents are greatly reduced. Since the arrangement is highly compact, also the parasitic capacity is low.

Below, the I-inductor according to the invention will be described in greater detail on the basis of the accompanying drawings.

DESCRIPTION OF PREFERRED EMBODIMENTS

Figure 3A:
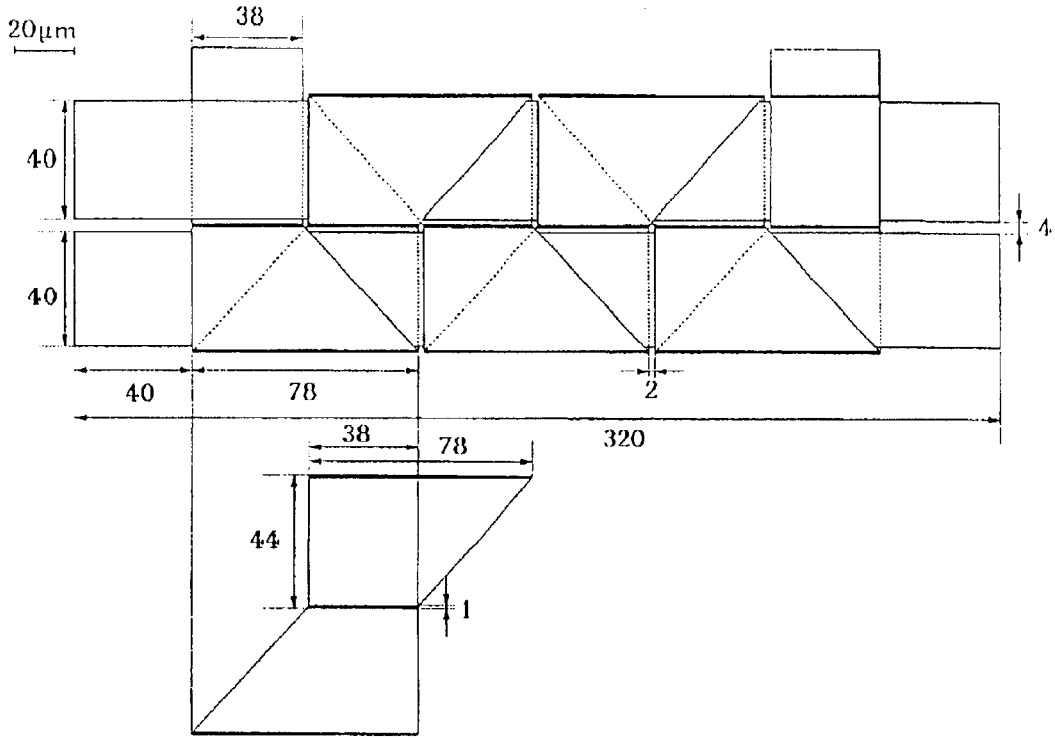
FIG. 3*a* shows an arrangement of double trapezoidal elements with two cores.

The I-inductor, which will be described below in greater detail, is an HF micro-inductor with typical dimensions as they are indicated in FIG. 3*a*.

It is a component for micro-systems engineering in planar design and is used in high frequency equipment at 1–10 GHz. It is manufactured by thin film techniques. The I-inductor is limited in its length in order to provide for the desired microwave-technical properties, which are necessary for the intended use. The upper limit for the length of the component in x-direction (see coordinate system in FIGS. 1 and 5) is:

$$1_x < \alpha \frac{c}{f\mu_{rx}}, \text{ wherein } \alpha < 1/4$$

$\alpha$ is a dimensionless factor; for the technical applications 0.1 has been found to be optimal.

C is the speed of light and $\mu_{rx}$ is the relative magnetic permeability constant in x-direction.

Figure 1:
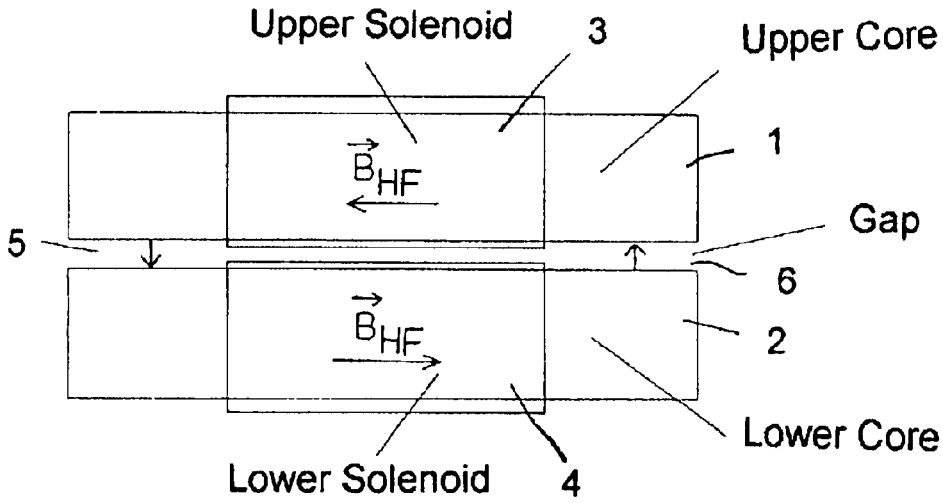
FIG. 1 is a schematic view showing an I-inductor in principle.

First, the principle with which the present invention is concerned is presented on the basis of FIG. 1. The I-inductor consists of two parallel, expediently rectangular bodies 1 and 2, also called cores by the persons skilled in the field, of a magnetically permeable material. Onto each iron core a solenoid 3, 4 is wound. Both solenoids may be connected electrically in different ways, they may be connected separately or they may be connected in series or in a parallel circuit but they must be connected in such a way that the magnetic field in one core has the opposite direction of that in the other. When both solenoids are then energized a magnetic circuit is generated by way of the two cores and the magnetic flux circuit is closed by way of the two gaps 5,6 at the two end areas of the arrangement.

The gaps 5,6 may be filled with the same magnetic material. If magnetically anisotropic materials are used, they have preferably an anisotropy with a preferred direction from one core to the other. For high frequency applications, the gaps 5,6 should be as small as possible, but at least large enough so that for the operation, it provides for sufficient electrical insulation. The size of the whole arrangement is also limited by parasitic capacities.

The two solenoids shown in FIG. 1 are formed from one winding that is they are not separately wound. For an optimal performance of the inductor, it is advantageous to integrate the upper and the lower solenoids with each other. The winding technique as sketched shows that always one winding turn of the upper solenoid is wound so as to be disposed adjacent one of the lower solenoid in series and vice versa over the whole length of the winding. Also, the winding sense is such that the magnetic fields generated by the two windings add to each other in the circuit and do not subtract from, or eliminate, each other. The two solenoids are therefore not separate adjacent solenoids. The arrangement can be provided by a planar technique or layer technique by successively building up the layers in a simple manner. However, the respective conductor connections in the gap and at the outer longitudinal edges must be provided later.

Figure 2:
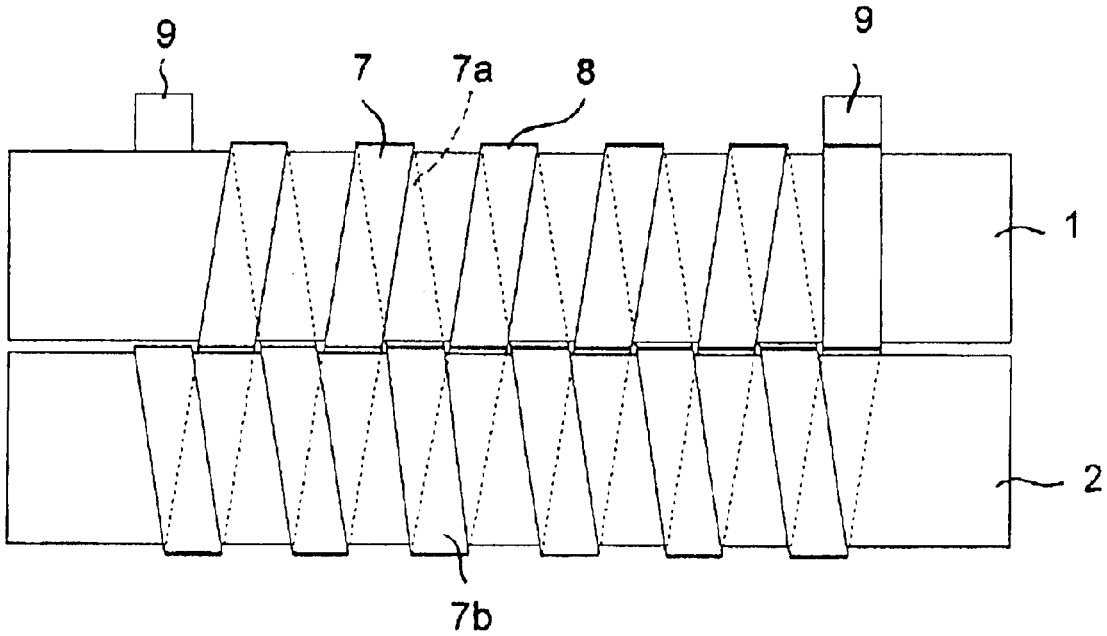
FIG. 2 shows a flat conductor winding for the I-conductor.

For the manufacturing procedure, the arrangement as shown in FIG. 3*a* is advantageous—also with respect to the high-frequency properties. The winding as shown in principle in FIG. 2 is formed from double trapezoidal conductor elements of copper or aluminum which are joined. One half 7*a* of the double trapezoidal structure is disposed on the backside of a core 1 the other half 7*b* is pulled through the gap and disposed on the other core 2. Then follows the next double trapezoidal conductor part 8 in the same way until the double winding of two cores 1,2 is finished. In this special arrangement, the two windings consist of six double trapezoidal elements of aluminum. At both ends of the conductor, a tap 9 is finally provided for the electrical connections. The construction with parallelogram elements is accordingly. Both cores 1,2 consist of an iron alloy whose magnetic anisotropy is adjustable by the manufacturing process.

Figure 3B:
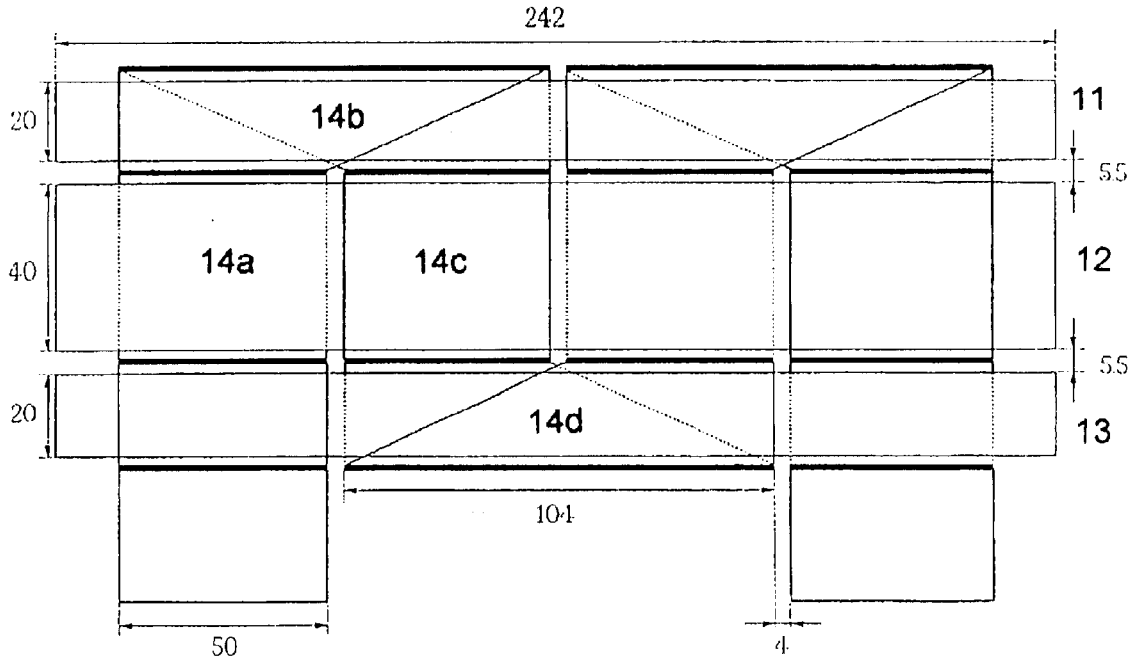
FIG. 3*b* shows an arrangement of double trapezoidal and rectangular elements for an arrangement with more than two cores.

For an arrangement with more than two cores, the arrangement as shown with in FIG. 3*b* with three cores is appropriate. The trapezoidal conductor elements are still disposed adjacent the two outer cores 11,13, the intermediate core 12 is contacted by the rectangular conductor strips 14 *a,b,c* . . . , which at both sides are as wide as the smaller of the two parallel trapezoidal sides and which are aligned therewith. In contrast to the two outer cores 11,13 which are almost fully covered by the conductor elements over the whole winding width except for the spaces between the conductors, with this technique the intermediate cores is only half covered. The rectangular conductor elements extend along an intermediate core alternately in the back and in the front. In order to achieve the highest possible conductor coverage over the whole winding width with more than two bodies/cores, each body/core must have its own conductor winding and at the same time no others should be wound thereon.

Figure 6:
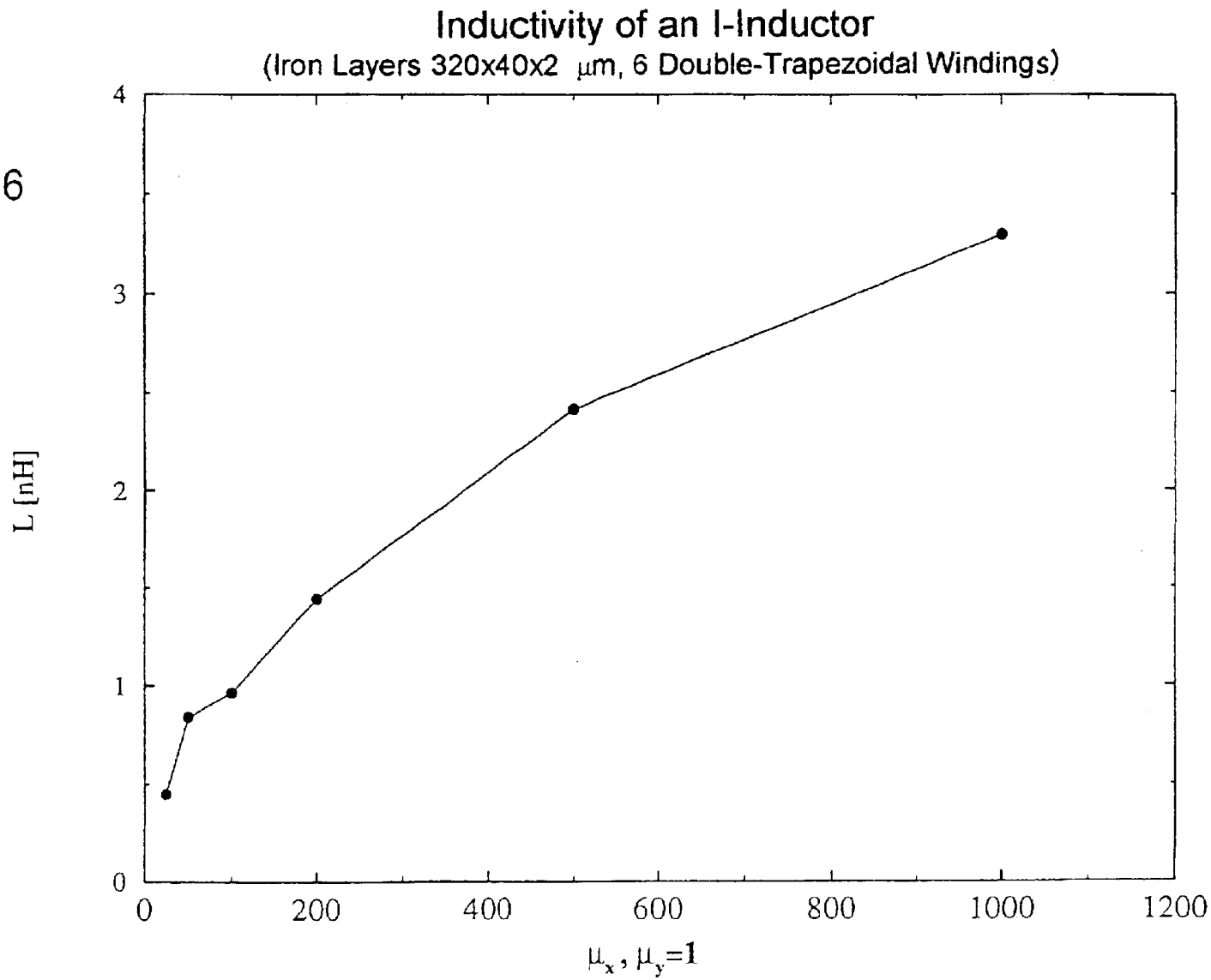
FIG. 6 shows the inductivity curve of an I-conductor according to FIG. 3*a*.

FIG. 6 shows a curve indicating the inductivity of the I-inductor in nH depending on the permeability $\mu_{fx}$ present in the x-direction, whose windings consist of double trapezoidal elements as shown in FIG. 3*a*. The core or here iron layers have the contour 320×40×2 $(\mu m)^3$. The permeability $\mu_{ry}$ in y-direction is 1. With $\mu_{ry}$=1000 an inductivity of 3 nH is achieved in such an arrangement.

Before an actual arrangement is presented, on the basis of FIG. 4, also the structure of a high frequency transmitter or a transformer on the basis of the I-inductor principle will be explained. The main area of application herefor is in the field of telecommunication, particularly in elements such as blocking circuits or cellular telephones. But also in signal transmission systems, such as satellite systems or in the digital network arrangements for data transmissions over long distances this technology is increasingly found attractive because a further miniaturization can be achieved.

Figure 4:
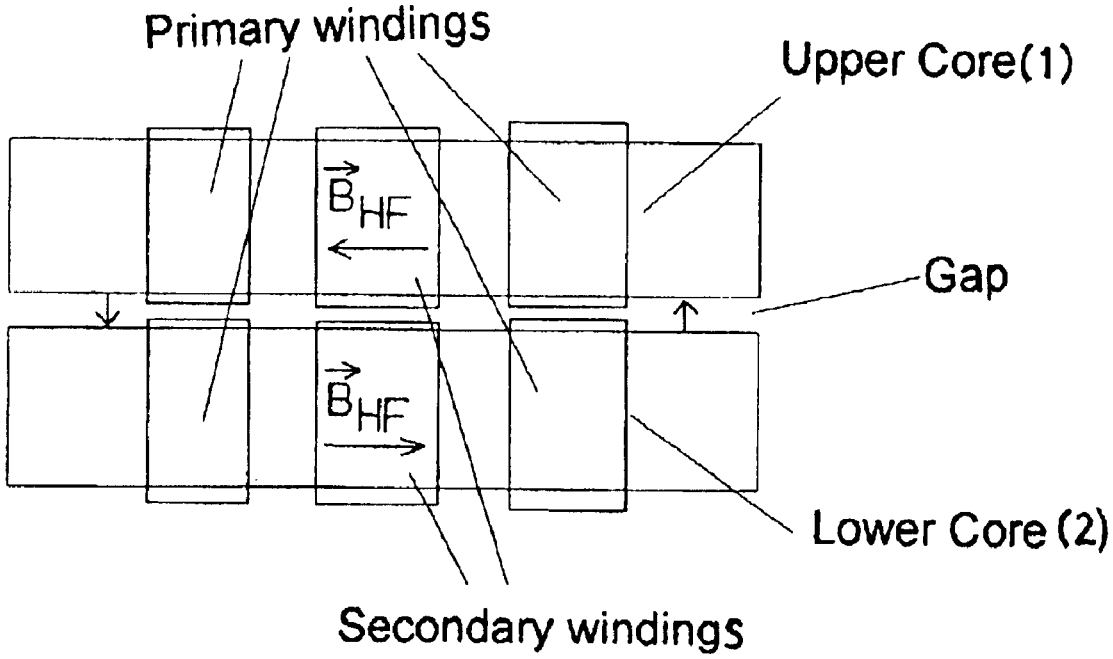
FIG. 4 shows the I-inductor with secondary windings as HF transmitter.

The principle of the anti-parallel magnetic excitation is utilized for the construction of a high-frequency transmitter and the galvanic separation of electrical circuits is achieved therewith or it is utilized for the construction of a micro-transformer (FIG. 4). For an I-inductor (FIGS. 1 to 3) and also for a high frequency transmitter based on this principle, the frequency range is increased by the superimposition of an anisotropy. In the present case, this is achieved by an external static magnetic field which is normal to the I-inductor, and which is generated for example by a planar H- or C-magnet (FIG. 4). For simplified manufacturing, the core of the planar H- or C-magnet consists also of the same material with uniaxial anisotropy. By varying the static magnetic field, the limit frequency of the component is increased with increasing magnetic flux depth or, respectively, the inductivity is lowered. For reasons of installation or connections, the C-magnet is probably the component preferred over the H magnet.

Figure 5:
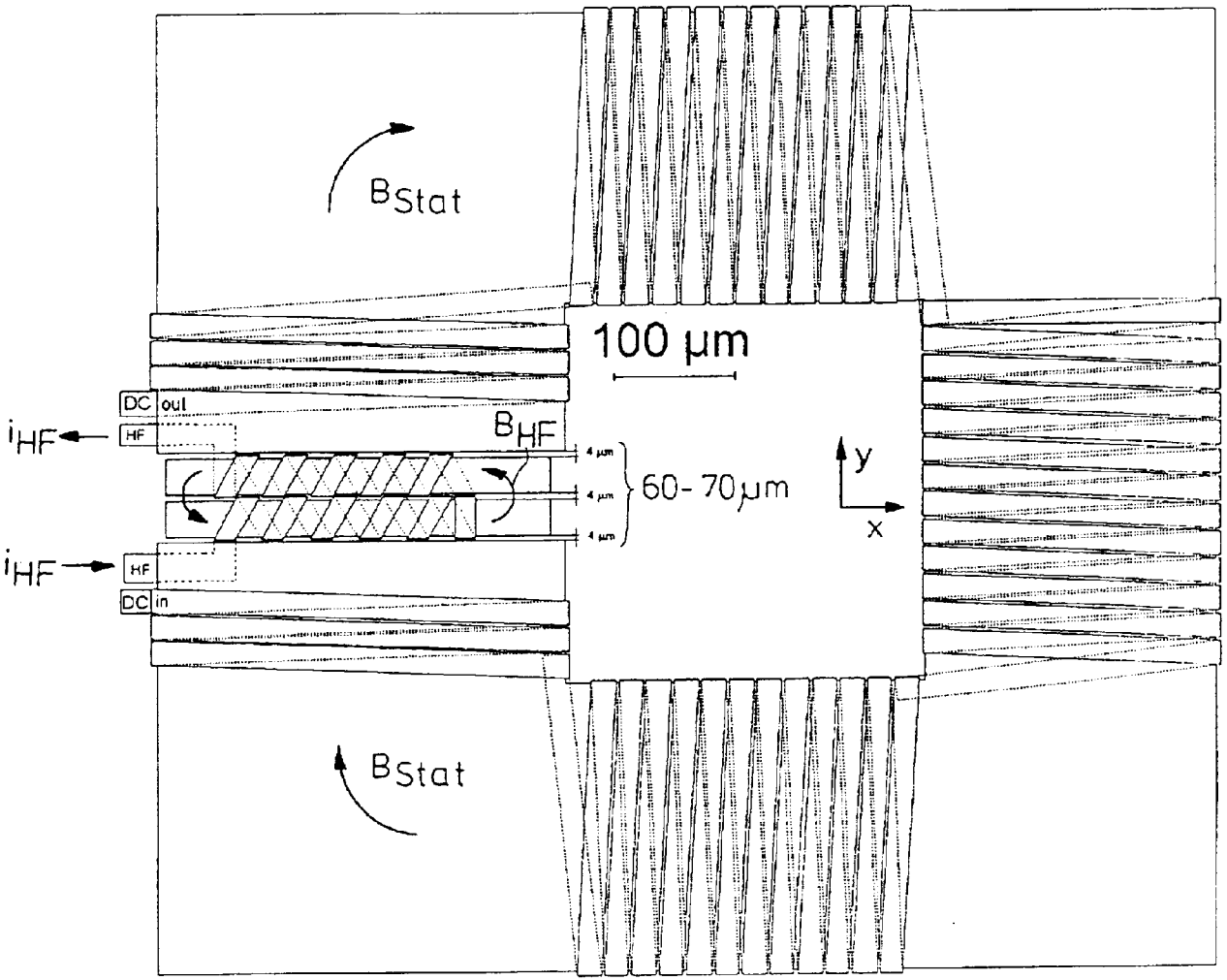
FIG. 5 shows the I-inductor in the gap of a C magnet.

FIG. 5 is a top view of the I-inductor installed in the air gap of the C-magnet. It is realized by means of planar technology. The dimensions given show the miniaturizing potential. The I-inductor itself is constructed and wound in accordance with FIG. 2. It has a width of only 60–70 $\mu$m and a gap between the cores and a distance from the respective poles of only 4 $\mu$m. The open space in the C-interior has an expansion of only $(250\ \mu m)^2$ corresponding to an outer contour of about 800 $\mu$m or 0.8 mm length.

The static field generation $B_{stat}$ in the C-magnet is highly efficient since magnetically non-axial anisotropic materials have in the static case in y-direction a permeability >>1. The magnetic anisotropy in the C-material provides for a permeability of $\mu_{statx}\approx 350$ and $\mu_{staty}\approx 1000$; for the I-inductor the values are: $\mu_{HFx}\approx 350$ and $\mu_{Hfy}=1$.

The five winding packets on the C-yoke are energized by a DC current and therefore generate a constant or static magnetic field which extends through the field in the cores of the I-inductor normally thereto and which increases in this way the magnetic anisotropy and, consequently, the limit frequency. For this application, isotropic magnetic materials cannot be used.

Literature

I

"Ferromagnetismus" von Kneller, E., Seiten 642 und 643, "Snoek'sche Limit" (Seite 643), Springer Verlag Berlin/Göttingen/Heidelberg, 1962.

II

Shinji Tanabe, Yasuhiro Shiraki, Masahiro Yamauchi, Ken-ichi Arai, FEM Analysis of Thin Film Inductors Used in GHz Frequenzy Bands IEEE Transactions on Magnetics., Vol 35, No. 35, September 1999)

III

J. Driesen, W. Ruythooren, R. Belmans, J. De Boeck, J-P. Celais, K-Hameyer, Electric and Magnetic FEM Modeling Strategies For Micro-Inductors, IEEE Transactions on Magnetics., Vol. 35, No:5, September 1999)

IV

A. Gromov, V. Korenivskim, K. V. Rao R. B. van Dover, P. M. Mankiewich, A Model for Impedance of Planar RF Inductors Based on Magnetic Films, IEEE Transactions on Magnetics 1998).

What is claimed is:

1. An I-inductor in the form of a high frequency-micro-inductor (HF inductor) for microsystems, comprising: adjacent cores of a magnetic permeable material, which are arranged in a rectangularly limiting plane with a gap therebetween and which are band-like and have parallel longitudinal axes and the same length and a cross-section sufficient to accommodate a predetermined magnetic flux, said cores being provided with a winding such that, upon energization of the winding, the magnetic flux generated by a turn of the winding in immediately adjacent cores extends fully in the magnetic material of the cores and the magnetic field generated in each core has a direction in which the flux in the adjacent core is amplified.

2. An I-inductor according to claim 1, wherein said cores consist of a magnetically isotropic material.

3. An I-inductor according to claim 2, wherein the magnetically isotropic material is uni-directionally or uni-axially isotropic.

4. An I-inductor according to claim 3, wherein said inductor includes two outer cores, which have the same width and at least one inner core disposed between the outer cores, said at least one inner core being at least as wide as the outer cores.

5. An I-inductor according to claim 4, wherein each core is provided with a winding formed by a solenoid.

6. An I-inductor according to claim 4, wherein the windings comprise a flat conductor which is provided at its opposite ends with a tab for an external connection.

7. An I-inductor according to claim 4, wherein the windings form together with the cores a woven structure.

8. An I-inductor according to claim 6, wherein the windings consist of flat conductor elements extending around two cores, said conductor elements being uniformly trapezoidal and being disposed adjacent to, and in contact with, each other in the gap between the two cores along the shorter of the two parallel trapezoid sides and along the respective outer longitudinal edge of the two bodies/cores with the longer of the two parallel trapezoid sides.

9. An I-inductor according to claim 6, wherein the windings consist of flat conductor elements ex tending around more than two cores, said conductor elements of a winding disposed on the two outer cores are uniformly trapezoidal and those disposed on the inner bodies/cores are uniformly rectangular, the trapezoidal elements of the winding are disposed adjacent to, and in contact with, the respective outer edges of the two outer cores, with the longer of the two parallel trapezoid sides and in the gaps between the two outer cores and the respective adjacent core are disposed adjacent to, and in contact with, a rectangular element of the winding with sides of equal length along the respective shorter sides of the two parallel trapezoidal sides of an element of the turn and, in the gap between the inner cores, always two rectangular elements of the turns are disposed adjacent, and in contact with, each other so that the turns are disposed with the cores in an insulating spaced relationship in a web-like form adjacent one another and at both ends of a winding, there is a tab for an external connection.

* * * * *